US011624101B2

(12) United States Patent
So et al.

(10) Patent No.: US 11,624,101 B2
(45) Date of Patent: Apr. 11, 2023

(54) STEEL FOR PRESSURE VESSEL HAVING EXCELLENT SURFACE QUALITY AND IMPACT TOUGHNESS, AND METHOD FOR MANUFACTURING SAME

(71) Applicant: POSCO, Pohang-si (KR)

(72) Inventors: Tae-Il So, Gwangyang-si (KR); Dae-Woo Kim, Pohang-si (KR); Sang-Deok Kang, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 48 days.

(21) Appl. No.: 17/266,692

(22) PCT Filed: Aug. 2, 2019

(86) PCT No.: PCT/KR2019/009679
§ 371 (c)(1),
(2) Date: Feb. 8, 2021

(87) PCT Pub. No.: WO2020/032493
PCT Pub. Date: Feb. 13, 2020

(65) Prior Publication Data

US 2021/0301365 A1 Sep. 30, 2021

(30) Foreign Application Priority Data

Aug. 7, 2018 (KR) ..... 10-2018-0091841

(51) Int. Cl.

| | |
|---|---|
| ***C21D 9/50*** | (2006.01) |
| ***C21D 8/02*** | (2006.01) |
| ***C21D 6/00*** | (2006.01) |
| ***C22C 38/16*** | (2006.01) |
| ***C22C 38/14*** | (2006.01) |
| ***C22C 38/12*** | (2006.01) |
| ***C22C 38/06*** | (2006.01) |
| ***C22C 38/02*** | (2006.01) |
| ***C22C 38/00*** | (2006.01) |
| ***C22C 38/04*** | (2006.01) |

(52) U.S. Cl.

CPC ..... *C21D 9/50* (2013.01); *C21D 6/005* (2013.01); *C21D 6/008* (2013.01); *C21D 8/0205* (2013.01); *C21D 8/0226* (2013.01); *C21D 8/0294* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | |
|---|---|---|---|
| 2018/0371568 | A1 | 12/2018 | Hong |
| 2019/0024206 | A1 | 1/2019 | Kim |
| 2019/0100818 | A1 | 4/2019 | Kim et al. |
| 2019/0264306 | A1 | 8/2019 | Kim et al. |
| 2020/0095649 | A1 | 3/2020 | Cha et al. |
| 2020/0263279 | A1 | 8/2020 | Um et al. |

FOREIGN PATENT DOCUMENTS

| | | | | |
|---|---|---|---|---|
| EP | 3336212 | A1 | | 6/2018 |
| JP | H09-202919 | A | | 8/1997 |
| JP | 10102194 | A | * | 4/1998 |
| JP | H10-102193 | A | | 4/1998 |
| JP | H10-102194 | A | | 4/1998 |
| JP | 2002-266022 | A | | 9/2002 |
| JP | 3842836 | B2 | | 11/2006 |
| KR | 10-2011-0060449 | A | | 6/2011 |
| KR | 10-2012-0067149 | A | | 6/2012 |
| KR | 10-2013-0077906 | A | | 7/2013 |
| KR | 10-2016-0078669 | A | | 7/2016 |
| KR | 10-2018-0053464 | A | | 5/2018 |
| WO | 2017/111290 | A1 | | 6/2017 |
| WO | 2017/111416 | A1 | | 6/2017 |
| WO | 2017105107 | A1 | | 6/2017 |
| WO | 2018/117545 | A1 | | 6/2018 |

OTHER PUBLICATIONS

Extended European Search Report dated Jun. 4, 2021 issued in European Patent Application No. 19847417.3.
International Search Report dated Nov. 12, 2019 issued in International Patent Application No. PCT/KR2019/009679 (with English translation).

* cited by examiner

*Primary Examiner* — Anthony M Liang
(74) *Attorney, Agent, or Firm* — Morgan, Lewis & Bockius LLP

(57) ABSTRACT

An aspect of the present invention provides: a steel for a pressure vessel, the steel having excellent surface quality while having excellent strength and toughness even after a long-term post-weld heat treatment (PWHT); and a method for manufacturing same.

11 Claims, 2 Drawing Sheets

【FIG.1】
(a)
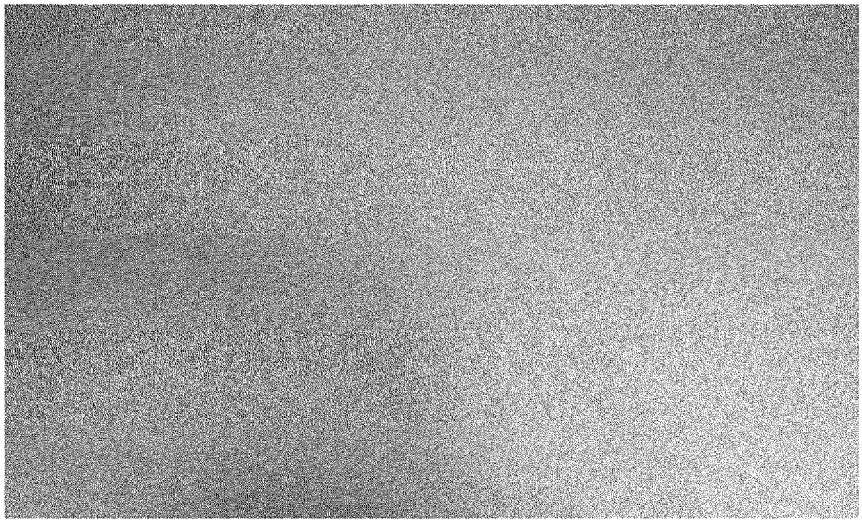
(b)
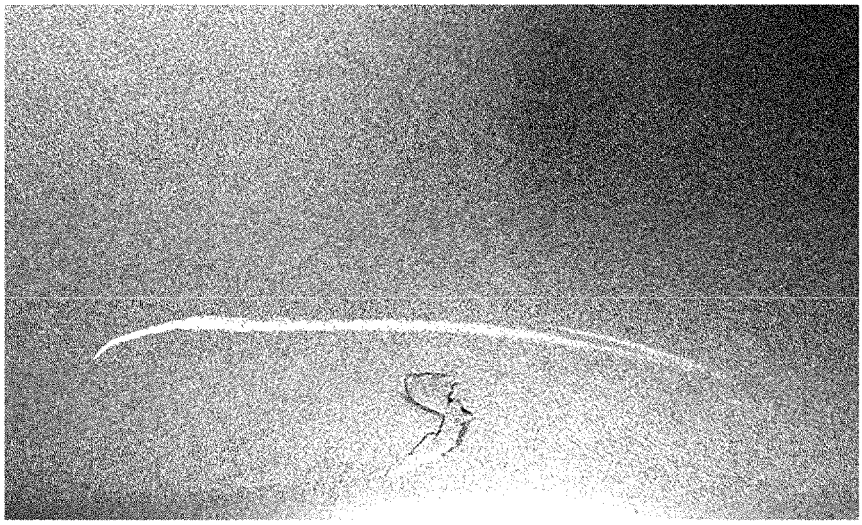

【FIG.2】
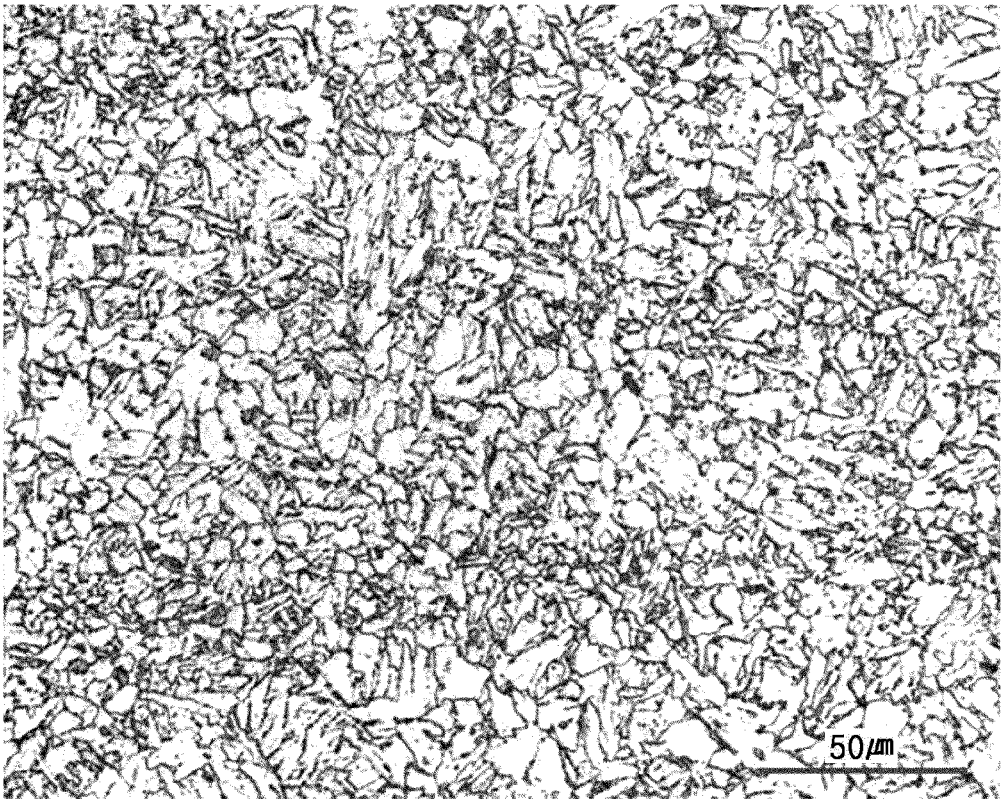

STEEL FOR PRESSURE VESSEL HAVING EXCELLENT SURFACE QUALITY AND IMPACT TOUGHNESS, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2019/009679, filed on Aug. 2, 2019, which in turn claims the benefit of Korean Application No. 10-2018-0091841, filed on Aug. 7, 2018, the entire disclosures of which applications are incorporated by reference herein.

TECHNICAL FIELD

The present disclosure relates to a steel material for petrochemical production equipment, storage tanks, and the like, and more particularly, to a steel material for a pressure vessel having excellent surface quality and impact toughness and a method for manufacturing same.

BACKGROUND ART

With recent demand for large-sized and high-capacity storage of equipment such as petrochemical production equipment and storage tanks, demand for thickening of steel materials for such equipment continues to increase. In particular, temperatures, at which toughness may be guaranteed, are gradually decreasing due to increasing demand for use of such equipment in extremely cold regions.

In addition, actual yield of steel materials used in such equipment is reduced due to surface defects such as generation of coining marks caused by scale, star cracking, or the like, which may occur during steelmaking/continuous casting or rolling, and thus, manufacturing costs are increased.

When such a steel material is welded, a post weld heat treatment (PWHT) is performed to prevent deformation of a structure after the welding, to stabilize a shape and a size, and to relieve stress generated during the welding. Such a post weld heat treatment is performed for a lengthy period to cause softening and growth of a steel sheet and coarseness of a carbonitride, so that strength and impact toughness are significantly deteriorated.

In particular, in the case of a high-strength steel material in which a microstructure includes a hard phase such as a bainite phase, a martensite phase, or a martensite-austenite (MA) phase, a base metal decreases in strength and tends to increase in ductile-to-brittle transition temperature (DBTT) through processes such as carbon re-diffusion, potential recovery, grain growth and carbide growth and precipitation, and the like, when a PWHT is performed for a lengthy period.

Patent Document 1 discloses a steel material having strength and toughness which are not reduced by forming a ferrite-bainite dual-phase microstructure and controlling a packet size of the bainite and size and amount of a carbonitride even after a PWHT is performed for a lengthy period.

However, according to Patent Document 1, a large amount of copper (Cu) is contained in an alloy composition to result in high sensitivity to occurrence of surface defects. In addition, a large amount of titanium (Ti) and a large amount of boron (B) are contained in the alloy composition, so that a value of low-temperature impact toughness is significantly decreased due to a coarse carbonitride. Accordingly, there is a limitation in simultaneously ensuring low-temperature toughness and surface quality after a PWHT.

(Patent Document 1) Korean Patent Registration No. 10-1657828

DISCLOSURE

Technical Problem

An aspect of the present disclosure is to provide a steel material for a pressure vessel having excellent surface quality while having excellent strength and toughness even after a post weld heat treatment (PWHT) is performed for a lengthy period, and a method of manufacturing the steel material.

The problem which the present disclosure may solve is not limited to the above. A person of skill in the art may understand additional problems which may be solved by the present disclosure from the overall description of the present disclosure

Technical Solution

According to an aspect of the present disclosure, a steel material for a pressure vessel having excellent surface quality and impact toughness includes, by weight percentage (wt %), 0.1 to 0.15% of carbon (C), 0.15 to 0.5% of silicon (Si), 1.2 to 1.8% of manganese (Mn), 0.01% or less (excluding 0%) of phosphorus (P), 0.01% or less (excluding 0%) of sulfur (S), 0.01 to 0.05% of aluminum (Al), 0.01 to 0.05% of niobium (Nb), 0.01 to 0.25% of nickel (Ni), 0.1% or less (excluding 0%) of copper (Cu), 0.01 to 0.1% of molybdenum (Mo), 0.01 to 0.05% of vanadium (V), 0.003% or less (excluding 0%) of titanium (Ti), 5 ppm or less (excluding 0 ppm) of boron (B), 20 to 100 ppm of nitrogen (N), and a balance of iron (Fe) and other inevitable impurities, and satisfying Relational Expression 1 below.

The steel material includes a composite structure of ferrite and bainitic ferrite as a microstructure.

$$0.5<[(Ti+Nb+B)/3.5N+(Cu/Ni)]<2.5 \quad \text{[Relational Expression 1]}$$

where each element refers to a content by wt %.

According to another aspect of the present disclosure, a method of manufacturing a steel material for a pressure vessel having excellent surface quality and impact toughness includes: reheating a steel slab, having the alloy composition above and satisfying Relational Expression 1 above, to a temperature of 1050 to 1200° C., rough rolling the reheated slab within a temperature range of Ar3+100° C. to 1200° C.; finish hot rolling the rough-rolled slab at a temperature of Ar3+30° C. or more to manufacture a hot-rolled steel sheet; air cooling the hot-rolled steel sheet to room temperature; reheating the air-cooled hot-rolled steel sheet to a temperature of Ac3 or higher, and then maintaining the reheated hot-rolled steel sheet for (1.3t+20) minutes or more (where t refers to a thickness (mm) of the steel material); cooling the hot-rolled steel sheet to room temperature at a cooling rate of 2° C./sec or more after the maintaining; performing a tempering process in which the cooled hot-rolled steel sheet is maintained within a temperature range of 600 to 700° C. for (1.9t+30) minutes or more; and air cooling the hot-rolled steel sheet to room temperature after performing the tempering process.

Advantageous Effects

According to the present disclosure, a steel material for a pressure vessel, having excellent surface quality as well as excellent strength and impact toughness even after a post weld heat treatment (PWHT) is performed, may be provided.

In addition, a steel material of the present disclosure may be appropriately applied to petrochemical production equipment, storage tanks, and the like.

DESCRIPTION OF DRAWINGS

FIG. 1 illustrates a result obtained by observing a surface of Inventive Steel 1 and a surface of Comparative Steel 1, according to an embodiment of the present disclosure.

FIG. 2 illustrates a result obtained by observing a microstructure in a ¼t point of Inventive Steel (a material having a thickness of 700 mm) according to an embodiment of the present disclosure.

BEST MODE FOR INVENTION

The present inventors have conducted deep research into a steel material for a pressure vessel having improved surface quality as well as excellent strength and toughness even when a post weld heat treatment (PWHT) is performed on the steel material for a pressure vessel for a lengthy period. As a result, it is confirmed that a steel material, capable of securing target strength and tough even after a post weld heat treatment (PWHT) is performed at high temperature for a lengthy period and significantly reducing defects such as star cracking in a surface, may be provided by optimizing an alloy composition and manufacturing conditions. Based on this knowledge, the inventors have implemented the present disclosure.

In particular, the present inventors have found that it is necessary to control addition and composition of alloying elements so as to reduce sensitivity to occurrence of surface defects during a process of manufacturing a steel material for a pressure vessel.

Specifically, in an alloy composition of steel, copper (Cu) is effective in improving strength, but causes star cracking to occur in a surface of the steel and embrittles grain boundaries as enrichment occurs due to selective oxidation. Therefore, a content of Cu needs to be appropriately controlled, together with nickel (Ni).

In addition, when nitrogen (N) is excessively added, there is a possibility that N may react with aluminum (Al) in the steel to form an AlN precipitate causing surface defects. To inhibit formation of such a precipitate, it is advantageous to form a carbonitride (for example, (Ti,Nb) (C,N)) or a boron compound (BN) through addition of elements such as titanium (Ti), niobium (Nb), boron (B), and the like. However, when the carbonitride is coarsely formed, the carbonitride reacts as a cracking initiation point to significantly reduce low-temperature impact toughness. For this reason, it is necessary to appropriately control contents of the elements.

Hereinafter, the present disclosure will be described in detail.

According to an aspect of the present disclosure, a steel material for a pressure vessel having excellent surface quality and impact toughness includes, by weight percentage (wt %), in detail, 0.1 to 0.15% of carbon (C), 0.15 to 0.5% of silicon (Si), 1.2 to 1.8% of manganese (Mn), 0.01% or less (excluding 0%) of phosphorus (P), 0.01% or less (excluding 0%) of sulfur (S), 0.01 to 0.05% of aluminum (Al), 0.01 to 0.05% of niobium (Nb), 0.01 to 0.25% of nickel (Ni), 0.1% or less (excluding 0%) of copper (Cu), 0.01 to 0.1% of molybdenum (Mo), 0.01 to 0.05% of vanadium (V), 0.003% or less (excluding 0%) of titanium (Ti), 5 ppm or less (excluding 0 ppm) of boron (B), and 20 to 100 ppm of nitrogen (N).

Hereinafter, the reason for controlling the alloy components of a steel material for a pressure vessel according to the present disclosure will be described in detail, and unless otherwise stated, the contents of the respective components may refer to weight percentage (wt %).

Carbon (C): 0.1 to 0.15%

Carbon (C) is an element effective in improving the strength of steel, and C is included in an amount of, in detail, 0.01% or more to secure sufficient strength. However, when the content of C is greater than 0.15%, low-temperature impact toughness of a base metal and a welding zone may be significantly reduced.

Therefore, in the present disclosure, the content of C may be, in detail, 0.1 to 0.15%, and, in more detail, 0.12 to 0.14%.

Silicon (Si): 0.15 to 0.5%

Silicon (Si) is used as a deoxidizer, and is an element advantageous for improving strength and toughness. When the content of Si is greater than 0.5%, low-temperature toughness may be decreased and weldability may be deteriorated. When the content of Si is less than 0.15%, a deoxidation effect may be insufficient.

Therefore, in the present invention, the content of Si may be, in detail, 0.15 to 0.5%.

Manganese (Mn): 1.2 to 1.8%

Manganese (Mn) is an element advantageous for securing strength due to a solid solution strengthening effect. To this end, the content of Mn may be, in detail, 1.2% or more. However, when the content of Mn is greater than 1.8%, Mn may combine with Sin the steel to form MnS, causing room-temperature elongation and low-temperature toughness to be significantly reduced.

Therefore, in the present disclosure, the content of Mn may be, in detail, 1.2 to 1.8%. More advantageously, Mn may be included in an amount of 1.3 to 1.7%.

Phosphorus (P): 0.01% or Less (Excluding 0%)

Phosphorus (P) is an element advantageous for securing strength and corrosion resistance of steel. However, when the content of P is significantly high, impact toughness may be significantly reduced. Accordingly, the content of P may be maintained as low as possible.

Therefore, in the present disclosure, the content of P may be controlled to be 0.01% or less. More advantageously, the content of P may be controlled to be 0.008% or less. However, 0% is excluded in consideration of an inevitably added level of P.

Sulfur (S): 0.01% or Less (Excluding 0%)

Sulfur (S) is an impurity present in steel. When the content of S is greater than 0.01%, S may combine with Mn to form a non-metallic inclusions (for example, MnS), causing impact toughness of the steel to be significantly reduced.

Therefore, in the present disclosure, the content of S may be, in detail, 0.01% or less. More advantageously, the content of S may be controlled to be 0.003% or less.

Aluminum (Al): 0.01 to 0.05%

Aluminum (Al) is an element added to deoxidize molten steel, and may be included in an amount of, in detail, 0.01% or more to sufficiently obtain the deoxidation effect. However, when the content of Al is greater than 0.05%, nozzle clogging may occur during continuous casting.

Therefore, in the present disclosure, the content of Al may be, in detail, 0.01 to 0.05%.

Niobium (Nb): 0.01 to 0.05%

Niobium (Nb) precipitates in the form of NbC or Nb(C,N) to significantly improve strength of a base metal and a welding zone. Moreover, Nb solid-solubilized during high-temperature reheating may inhibit recrystallization of austenite and transformation of ferrite or bainite to refine a structure. In addition, even in a cooling process after a rolling process, Nb may improve stability of austenite to promote formation of a hard phase such as martensite or bainite even in cooling at a low rate. Therefore, Nb is useful in securing the strength of the base metal.

To sufficiently obtain the above-described effect, Nb may be included in an amount of, in detail, 0.01% or more. However, Nb is an expensive element and, when a significantly large amount of Nb is added together with Ti, coarse (Ti,Nb) (C,N) may be formed during a heating process or after a PWHT to reduce low-temperature impact toughness.

Therefore, in the present disclosure, the content of Nb may be, in detail, 0.01 to 0.05%.

Nickel (Ni): 0.01 to 0.25%

Nickel (Ni) is an element, capable of simultaneously improving strength and toughness of the base material. To obtain such an effect, Ni may be included in an amount of, in detail, 0.01% or more. Since Ni is an expensive element, it may be economically disadvantageous to include Ni in an amount of greater than 0.25%.

Therefore, in the present disclosure, the content of Ni may be, in detail, 0.01 to 0.25%.

Copper (Cu): 0.1% or Less (Excluding 0%)

Copper (Cu) is an element, capable of improving strength while significantly reducing a decrease in the toughness of the base material. However, when Cu is included in a significantly large amount, surface quality of a product may be significantly deteriorated. Therefore, in the present disclosure, Cu may be included in an amount of, in detail, 0.1% or less (excluding 0%).

Molybdenum (Mo): 0.01 to 0.1%

Molybdenum (Mo) has an effect of inducing formation of a bainite or martensite phase while significantly improving hardenability to inhibit formation of ferrite even when a small amount of Mo is added. In addition, Mo is advantageous for significantly improving the strength of the steel. To obtain such effects, Mo may be included in an amount of, in detail, 0.01% or more. However, when the content of Mo is greater than 0.1%, there is a high possibility that hardness of a welding zone may be significantly increased to reduce toughness.

Therefore, in the present disclosure, Mo may be included in an amount of, in detail, 0.01 to 0.1%. More advantageously, Mo may be included in an amount of 0.05 to 0.08%.

Vanadium (V): 0.01 to 0.05%

Vanadium (V) is solid-solubilized at a lower temperature than other alloying elements, and may precipitate in a heat-effected zone (HAZ) to prevent a decrease in strength. Accordingly, when the strength is insufficiently secured after a post weld heat treatment (PWHT), V may be included in an amount of 0.01% or more. However, when the content of V is greater than 0.05%, a fraction of a hard phase such as an MA phase may be significantly increased to deteriorate low-temperature impact toughness of a welding zone.

Therefore, V may be added in an amount of 0.01 to 0.05%.

Titanium (Ti): 0.003% or Less (Excluding 0%)

Titanium (Ti) is an element added to reduce occurrence of surface cracking caused by the formation of AlN precipitates. However, when the content of Ti is greater than 0.003%, a coarse (Ti,Nb) (C,N) carbonitride may be formed during reheating, tempering or post weld heat treatment (PWHT) to reduce low-temperature impact toughness.

Therefore, in the present disclosure, the content of Ti may be, in detail, 0.003% or less (excluding 0%).

Boron (B): 5 ppm or Less (Excluding 0%)

Boron (B) is an element improving hardenability even when added in a significantly small amount. However, when the content of B is greater than 5 ppm, low-temperature impact toughness may be significantly reduced.

Therefore, in the present disclosure, the content of B may be 5 ppm or less (excluding 0%).

Nitrogen (N): 20 to 100 ppm

When nitrogen (N) is added together with titanium (Ti), TiN precipitates may be formed to inhibit grain growth caused by welding heat affect. However, when a significantly large amount of N is added, coarse TiN may be formed to reduce low-temperature impact toughness and AlN may be formed to cause surface cracking. Therefore, N may be included in an amount of, in detail, less than 100 ppm. To control the amount of N to be less than 20 ppm, a steelmaking load may be significantly increased and a grain growth inhibition effect may be insufficient.

Therefore, in the present disclosure, the content of N may be, in detail, 20 to 100 ppm. More advantageously, N may be included in an amount of 20 to 50 ppm.

In the present disclosure, a balance thereof may be iron (Fe). However, in a common steel manufacturing process, unintended impurities may be inevitably incorporated from raw materials or steel manufacturing environments, so that they may not be excluded. These impurities are commonly known to a person skilled in the art, and are thus not specifically mentioned in this specification.

The steel material of the present disclosure, having the above-described alloy composition, may satisfy a component relationship expressed by the following relationship.

In the following component relational expression, Ti, Nb, B, N, Cu, and Ni are elements affecting surface quality and low-temperature toughness of a steel material. The surface quality and the low-temperature toughness may be more advantageously improved by controlling the content of each of the above elements and controlling a content relationship of the above elements by Relational Expression 1.

In this case, when a value of Relational Expression 1 is 0.5 or less, there is a concern that an AlN precipitate may be formed by excess nitrogen to further deteriorate the surface quality and sufficient strength may not be secured. On the other hand, when the value of Relational Expression 1 is greater than 2.5, a coarse TiNb(C,N) carbonitride may be formed to increase the possibility that low-temperature impact toughness is deteriorated and star cracking occurs in a surface of the steel.

$$0.5<[(Ti+Nb+B)/3.5N+(Cu/Ni)]<2.5 \quad \text{[Relational Expression 1]}$$

(where each element refers to a content by wt %)

The steel material of the present disclosure, satisfying the above-described alloy composition and Relational Expression 1, may include, in detail, a composite structure of ferrite and bainitic ferrite as a main structure, a microstructure. Here, ferrite refers to acicular ferrite.

In particular, in the present disclosure, a fraction of the microstructure may be preferably controlled depending on a thickness of a steel material to be manufactured.

More specifically, when a thickness of the steel material is greater than 35 mm, a microstructure may include, in detail, ferrite having an area fraction of 40 to 80% and a balance of bainitic ferrite. Meanwhile, when the thickness of the steel material is 35 mm or less, the microstructure may include, in detail, ferrite having an area fraction of 20 to 60%, tempered martensite having an area fraction of 20% or less (including 0%), and a balance of bainitic ferrite.

When a ferrite phase is insufficiently formed in the microstructure, low-temperature impact toughness may be rapidly deteriorated. Meanwhile, when the ferrite phase is excessively formed, a target level of strength may not be secured. Accordingly, when a composite structure of ferrite and bainitic ferrite is formed as a matrix structure using a microstructure of a steel material provided by the present disclosure, a fraction of each phase may be preferably controlled to be within the above-described range.

In addition, the steel material of the present disclosure may include a carbonitride in a microstructure. In this case, the carbonitride is in the form of M(C,N), where M is at least one of Nb, Ti, and V, and a ratio of Nb is, in detail, 20% or more.

The above-described carbonitrides have an average particle diameter of, in detail, 100 nm or less. A case, in which the average particle diameter of the carbonitrides is greater than 100 nm, is not preferable because strength and toughness may be reduced.

As described above, in the present disclosure, a fine carbonitride may be formed to secure intended mechanical properties, in particular, excellent strength and toughness even after a PWHT and to secure excellent surface quality as well.

Specifically, the steel material of the present disclosure may secure tensile strength of 480 MPa or more and Charpy impact absorption energy of 150 J or more at a temperature of −50° C. in a ¼t point (where t refers to a thickness (mm) of the steel material) even after PWHT, and may secure excellent surface quality in which the number of star cracks in a surface of the steel material is less than or equal to 1 per unit area (50 $m^2$).

In addition, the steel material of the present disclosure may secure a tensile strength of 480 MPa or more and Charpy impact absorption energy of 100 J or more at a temperature of −50° C. in a ½t point of the steel material after a PWHT.

Hereinafter, a method of manufacturing a steel material for a pressure vessel having excellent surface quality and impact toughness, another aspect of the present disclosure, will be described in detail.

A steel slab, satisfying the alloy composition and Relational Expression 1 proposed in the present disclosure, is preferably manufactured and then reheated within a certain temperature range.

The steel slab may be a continuous casting slab obtained through continuous casting at a temperature of Ar3 or higher, or a forging slab obtained by forging the continuous casting slab to a thickness decreased by 10 to 60% of an initial thickness, but the present disclosure is not limited thereto.

In the present disclosure, the steel slab may be reheated within a temperature range of, in detail, 1050 to 1200° C. When the reheating temperature is higher 1200° C., austenite grains may be coarsened, and thus, a target level of physical properties may not be secured. On the other hand, when the reheating temperature is less than 1050° C., it may be difficult to re-solid-solubilize a carbonitride formed in the slab.

The reheated steel slab may be rough-rolled and finish hot-rolled to manufacture a hot-rolled steel sheet.

The rough rolling may be performed within a temperature range of, in detail, Ar3+100° C. to 1200° C. When the rough rolling temperature is lower than Ar3+100° C., an appropriate temperature may not be secured during a subsequent finish hot rolling.

After the rough rolling is completed within the above-mentioned temperature range, the finish hot rolling may be performed at a temperature of, in detail, Ar3+30° C. or higher. When the temperature is lower than Ar3+30° C. during the finish hot rolling, rolling load may make it difficult to perform normal hot rolling, so that a quality defect may occur.

In the present disclosure, Ar3 may be expressed as follows:

$$Ar3=910-310C-80Mn-20Cu-55Ni-80Mo+119V+124Ti-18Nb+179Al$$ (where each element refers to a content by wt %)

The hot rolling may be completed as described above, and air cooling may be then performed at room temperature. The air-cooled hot-rolled steel sheet may be reheated at a temperature of Ac3 or higher, in detail, within a temperature range of Ac3 or higher to 950° C. or less, and then maintained at the temperature for (1.3t+20) minutes or more (where t refers to a thickness (mm) of a steel material).

The reheating may be performed to form a structure of the hot-rolled steel sheet as a single-phase structure of austenite. In this case, when the temperature is less than Ac3 or the maintaining time is less than (1.3t+20) minutes, a two-phase structure of ferrite and austenite may be formed, so that a final structure may not be obtained as a desired structure. In addition, when the reheating temperature is higher than 950° C., the austenite structure may be coarsened, so that sufficient impact toughness may not be secured.

In the present disclosure, Ac3 may be represented as follows:

$$Ac3=937.2-436.5C+56Si-19.7Mn-26.6Ni+38.1Mo+124.8V+136.3Ti-19.1Nb+198.4Al$$ (where each element refers to a content by wt %)

The hot-rolled steel sheet, in which the structure is formed as 100% of an austenite phase by the reheating process, may be preferably quenched to room temperature at a cooling rate of 2° C./sec or higher.

In this case, when the cooling rate is lower than 2° C./sec, a size of ferrite grains or a packet of upper bainite may be coarsened, resulting in difficulty in securing target physical properties.

An upper limit of the cooling rate during the cooling is not necessarily limited, but may be limited to 100° C./sec in consideration of cooling equipment.

After the cooling is completed under the specific cooling conditions, a tempering process, in which the steel sheet is maintained within a temperature range of 600 to 700° C. for (1.9t+30) minutes or more, may be performed.

When the temperature is lower than 600° C. during the tempering process, it may be difficult to form fine precipitates, so that a target level of strength may not be secured. On the other hand, when the temperature is higher than 700° C., coarse precipitates may be formed to reduce low-temperature toughness.

On the other hand, when the maintaining time during the tempering process within the above-described temperature range is less than (1.9t+30) minutes, a temperature of a central portion of the hot-rolled steel sheet may not reach a target temperature. Accordingly, there is not enough time to precipitate a carbide from martensite, so that low-temperature toughness may be significantly deteriorated.

After the tempering is completed, the steel sheet may be air-cooled to room temperature.

The steel material of the present disclosure, manufactured through the above-described series of processes, may be further subjected to a post weld heat treatment (PWHT) process to relieve residual stress caused by a welding process added when the steel material is manufactured as a pressure vessel, or the like.

Conditions for the PWHT process are not necessarily limited, but the PWHT may be performed within a temperature range of 595 to 635° C. for 120 minutes or more.

In general, strength and toughness of steel are deteriorated after a lengthy PWHT process. Meanwhile, strength and toughness of the steel material of the present disclosure are not significantly reduced even when such a PWHT process is performed.

Specifically, the steel material of the present disclosure may secure tensile strength of 480 MPa or more and Charpy impact absorption energy of 100 J or more at a temperature of −50° C. even after a PWHT.

The steel material of the present disclosure may have a thickness of 10 to 150 mm. When the thickness of the steel material of the present disclosure is less than 10 mm, a shape defect may occur during a cooling process subsequent to a rolling or reheating process. On the other hand, when the thickness of the steel material of the present disclosure is greater than 150 mm, a cooling rate may be insufficient during a cooling process subsequent to a reheating process, and thus, a ferrite fraction may be excessively increased to result in difficulty in securing a target level of strength.

Hereinafter, the present disclosure will be described more specifically through examples. However, the following examples should be considered in a descriptive sense only and not for purposes of limitation. The scope of the present invention is defined by the appended claims, and modifications and variations may be reasonably made therefrom.

MODE FOR INVENTION

Examples

Steel slabs, having alloy compositions listed in Table 1, were reheated within a temperature range of 1120 to 1170° C. according to respective thicknesses (mm) thereof, and then finish hot-rolled at a temperature of 930 to 1000° C. to prepare hot-rolled steel sheets. Each of the hot-rolled steel sheets was air-cooled to room temperature, reheated to a temperature of 910° C., and then quenched to be cooled to room temperature. Each of the cooled hot-rolled steel sheets were tempered within a temperature range of 635 to 680° C., and then air-cooled to room temperature to manufacture a steel material. Each of the steel materials was subjected to a post weld heat treatment (PWHT) in which each of the steel materials was maintained at a temperature of 615° C. for 165 minutes. In this case, the PWHT was performed twice.

Manufacturing conditions based on thicknesses of steel slabs are listed in Table 2.

TABLE 1

| | Alloy Composition (wt %) | | | | | | | | | | | | | | |
|---|---|---|---|---|---|---|---|---|---|---|---|---|---|---|---|
| | C | Si | Mn | P | S | Al | Nb | Ni | Cu | Mo | Ti* | B* | N* | V | RE1 |
| IS1 | 0.126 | 0.36 | 1.53 | 0.0069 | 0.0007 | 0.0277 | 0.010 | 0.10 | 0.03 | 0.07 | 18 | 1 | 36 | 0.02 | 1.24 |
| IS2 | 0.125 | 0.46 | 1.57 | 0.0050 | 0.0007 | 0.0312 | 0.010 | 0.10 | 0.01 | 0.07 | 11 | 1 | 36 | 0.02 | 0.99 |
| CS1 | 0.095 | 0.36 | 1.56 | 0.0068 | 0.0007 | 0.0358 | 0.015 | 0.44 | 0.18 | 0.06 | 102 | 7 | 46 | 0.02 | 2.02 |
| CS2 | 0.104 | 0.34 | 1.53 | 0.0054 | 0.0010 | 0.0324 | 0.014 | 0.33 | 0.17 | 0.05 | 169 | 6 | 47 | 0.02 | 2.43 |
| CS3 | 0.105 | 0.32 | 1.55 | 0.0061 | 0.0010 | 0.0352 | 0.015 | 0.43 | 0.10 | 0.06 | 176 | 7 | 35 | 0.02 | 2.95 |

(In Table 1, each of Ti*, B*, and N* denotes a unit of component content in ppm.)
IS: Inventive Steel
CS: Comparative Steel
RE: relational expression

TABLE 2

| | | | Heating and Quenching | | | Tempering | | PWHT | | |
|---|---|---|---|---|---|---|---|---|---|---|
| THK (mm) | HFET (° C.) | FRT (° C.) | TEM (° C.) | MT (min) | CR (° C./s) | TEM (° C.) | MT (min) | TEM (° C.) | MT (min) | Cycle |
| 12 | 1170 | 930 | 910 | 36 | 82.5 | 680 | 60 | 615 | 165 | 2 |
| 30 | 1130 | 970 | 910 | 59 | 29.7 | 670 | 105 | 615 | 165 | 2 |
| 60 | 1130 | 990 | 910 | 98 | 8.6 | 645 | 180 | 615 | 165 | 2 |
| 65 | 1130 | 990 | 910 | 105 | 7.5 | 635 | 193 | 615 | 165 | 2 |
| 70 | 1130 | 990 | 910 | 111 | 6.5 | 645 | 205 | 615 | 165 | 2 |
| 80 | 1130 | 990 | 910 | 124 | 5.1 | 645 | 230 | 615 | 165 | 2 |
| 100 | 1130 | 985 | 910 | 150 | 3.5 | 645 | 280 | 615 | 165 | 2 |
| 120 | 1120 | 1000 | 910 | 176 | 2.5 | 645 | 438 | 615 | 165 | 2 |
| 150 | 1120 | 1000 | 910 | 215 | 2.1 | 635 | 540 | 615 | 165 | 2 |

THK: thickness
HFET: heating furnace extraction temperature
FRT: finish rolling temperature
TEM: temperature
MT: maintaining time
CR: cooling rate A microstructure of each ultimate steel material, on which a PWHT process was performed and completed, was observed and mechanical properties thereof were evaluated.

In each microstructure, a specimen was taken in a direction, perpendicular to a rolling direction, and then observed in a ¼t point with an optical microscope, and then ferrite, bainitic ferrite, and martensite phases were distinguished from each other by naked eye using electron backscatter diffraction (EBSD) equipment, and then a fraction of each of the phases was measured.

Mechanical properties of a steel material corresponding to a thickness of 70 mm, among the steel materials, were measured. In this case, JIS5 standard specimens were taken in a direction, perpendicular to the rolling direction, to measure tensile strength (TS), yield strength (YS), and elongation (El), and impact toughness (CVN), and results thereof are listed in Table 4. Each of the specimens was taken and measured in a ¼t point and a ½ point in a thickness direction.

The impact toughness was evaluated by performing a Charpy V-notch impact test at a temperature of −50° C. The impact toughness was measured three times, and an average value and individual values thereof are listed.

Surfaces, for example, an upper surface and a lower surface of each steel material were inspected by naked eye to evaluate the number of star cracks per unit area (50 $m^2$).

TABLE 3-continued

| | Thickness | Microstructure (area %) | | |
|---|---|---|---|---|
| | (mm) | Ferrite | Bainitic Ferrite | Tempered Martensite |
| Comparative Steel 1 | 12 | — | — | 100 |
| | 30 | — | — | 100 |
| | 60 | — | — | 100 |
| | 65 | — | 70.5 | 29.5 |
| | 70 | 62.4 | 32.2 | 5.4 |
| | 80 | 68.4 | 31.6 | — |
| | 100 | 73.1 | 26.9 | — |
| | 120 | 76.6 | 23.4 | — |
| | 150 | 76.2 | 23.8 | — |
| Comparative Steel 2 | 12 | — | — | 100 |
| | 30 | — | — | 100 |
| | 60 | — | — | 100 |
| | 65 | — | 71.3 | 28.7 |
| | 70 | 61.0 | 33.3 | 5.7 |
| | 80 | 67.2 | 32.8 | — |
| | 100 | 73.1 | 26.9 | — |
| | 120 | 75.6 | 24.4 | — |
| | 150 | 77.9 | 22.1 | — |
| Comparative Steel 3 | 12 | — | — | 100 |
| | 30 | — | — | 100 |
| | 60 | — | — | 100 |
| | 65 | — | 72.1 | 27.9 |
| | 70 | — | 93.8 | 6.2 |
| | 80 | 72.4 | 27.6 | — |
| | 100 | 76.7 | 23.3 | — |
| | 120 | 79.2 | 20.8 | — |
| | 150 | 80.4 | 19.6 | — |

TABLE 4

| | | 1/4t | | | | | | 1/2t | | | | | |
|---|---|---|---|---|---|---|---|---|---|---|---|---|---|
| | | Tensile Characteristics | | | | Impact Toughness | | Tensile Characteristics | | | | Impact Toughness | |
| | NOSC | YS | TS | E1 | | (-50° C., J) | | YS | TS | E1 | | (-50° C., J) | |
| | (/50m²) | (MPa) | (MPa) | (%) | YR | AV | IV | (MPa) | (MPa) | (%) | YR | AV | IV |
| IS1 | 0 | 432 | 556 | 33 | 78 | 306 | 236~332 | 420 | 547 | 32 | 77 | 264 | 121~369 |
| IS2 | 0 | 456 | 574 | 33 | 77 | 296 | 228~311 | 465 | 570 | 32 | 77 | 255 | 159~326 |
| CS1 | 5 | 449 | 551 | 32 | 82 | 281 | 22~365 | 442 | 562 | 32 | 81 | 214 | 21~306 |
| CS2 | 4 | 455 | 582 | 31 | 81 | 47 | 16~102 | 451 | 579 | 31 | 81 | 35 | 11~97 |
| CS3 | 5 | 453 | 586 | 32 | 77 | 33 | 12~89 | 455 | 572 | 31 | 80 | 80 | 10~78 |

TABLE 3

| | Thickness | Microstructure (area %) | | |
|---|---|---|---|---|
| | (mm) | Ferrite | Bainitic Ferrite | Tempered Martensite |
| Inventive Steel 1 | 12 | 21.4 | 61.4 | 17.2 |
| | 30 | 32.7 | 57.8 | 9.5 |
| | 60 | 62.1 | 37.9 | — |
| | 65 | 64.7 | 35.3 | — |
| | 70 | 67.4 | 32.6 | — |
| | 80 | 70.2 | 29.8 | — |
| | 100 | 72.9 | 27.1 | — |
| | 120 | 75.1 | 24.9 | — |
| | 150 | 78.2 | 21.8 | — |
| Inventive Steel 2 | 12 | 22.6 | 60.6 | 16.8 |
| | 30 | 34.3 | 57.3 | 8.4 |
| | 60 | 61.2 | 38.8 | — |
| | 65 | 64.2 | 35.8 | — |
| | 70 | 65.9 | 34.1 | — |
| | 80 | 71.6 | 28.4 | — |
| | 100 | 73.1 | 26.9 | — |
| | 120 | 74.6 | 25.4 | — |
| | 150 | 79.1 | 20.9 | — |

IS: Inventive Steel
CS: Comparative Steel
NOSC: number of star cracks
AV: average value
IV: individual value As illustrated in Table 3, thickness-dependent microstructures of steel materials, manufactured based on alloy compositions and manufacturing conditions proposed by the present disclosure, may be confirmed. Specifically, it may be confirmed that a steel material was formed to have a mixed structure of ferrite, bainitic ferrite, and tempered martensite when a thickness of the steel material was 30 mm or less, whereas a steel material was formed to have a two-phase structure of ferrite and bainitic ferrite when a thickness of the steel material was greater than 30 mm.

Comparative Steels 1 to 3, having alloy compositions which do not satisfying the present disclosure, were all formed to have a single-phase structure of tempered martensite because a great number of hardenability elements were contained when a thickness of a steel material was 60 mm or less, and were formed to have a composite structure of ferrite and bainitic ferrite or a composite structure of ferrite, bainitic ferrite, and tempered martensite when a thickness of a steel material was greater than 60 mm.

As illustrated in Table 4, Inventive Steels 1 and 2 exhibit excellent surface quality because no star crack was generated in surfaces thereof, whereas Comparative Steels 1 to 3 exhibit deteriorated surface quality because the number of generated star cracks were 5/50 $m^2$, 4/50 $m^2$, and 5/50 $m^2$, respectively (see FIG. 1). In Comparative Steels 1 to 3, star cracks are considered to be generated because a grain boundary was embrittled due to enrichment of copper (Cu) included in a large amount.

In addition, it may be confirmed that Inventive Steels 1 and 2 had excellent strength and impact toughness in a ¼t point and a ½t point in a thickness direction after a PWHT, whereas Comparative Steels 1 to 3 had deteriorated impact toughness after a PWHT. In the case of Comparative Steels 2 and 3, each having a relatively high content of titanium (Ti) as compared with Comparative Steel 1, a coarse (Ti,Nb)(C,N) carbonitride was formed as they were exposed to a high temperature for a lengthy period during a manufacturing process, and impact toughness is considered to be deteriorated because the carbonitride acted as a factor to induce cracking.

The invention claimed is:

1. A steel material for a pressure vessel, the steel material comprising:

by weight percentage, wt %, 0.1 to 0.15% of carbon (C), 0.15 to 0.5% of silicon (Si), 1.2 to 1.8% of manganese (Mn), 0.01% or less, excluding 0%, of phosphorus (P), 0.01% or less, excluding 0%, of sulfur (S), 0.01 to 0.05% of aluminum (Al), 0.01 to 0.05% of niobium (Nb), 0.01 to 0.25% of nickel (Ni), 0.1% or less, excluding 0%, of copper (Cu), 0.01 to 0.1% of molybdenum (Mo), 0.01 to 0.05% of vanadium (V), 0.003% or less, excluding 0%, of titanium (Ti), 5 ppm or less, excluding 0 ppm, of boron (B), 20 to 100 ppm of nitrogen (N), a balance of iron (Fe) and inevitable impurities, a composite structure of ferrite and bainitic ferrite as a microstructure, and the steel material satisfying Relational Expression 1 below, $$0.5<[(Ti+Nb+B)/3.5N+(Cu/Ni)]<2.5 \quad \text{[Relational Expression 1]}$$

where each element refers to a content by wt %.

2. The steel material of claim 1, wherein when a thickness of the steel material is greater than 35 mm, the steel material comprises ferrite having an area fraction of 40 to 80% and retained bainitic ferrite as the microstructure, and wherein when the thickness of the steel material is 35 mm or less, the steel material comprises ferrite having an area fraction of 20 to 60%, tempered martensite having an area fraction of 20% or less, including 0%, and retained bainitic ferrite as the microstructure.

3. The steel material of claim 1, wherein the steel material comprises an M(C,N) carbonitride having an average grain diameter of 100 nm or less in a microstructure, the M is niobium (Nb), titanium (Ti), or vanadium (V), and a ratio of the Nb is 20% or more.

4. The steel material of claim 1, wherein a number of star cracks in a surface of the steel material is less than or equal to 1 per 50 $m^2$ unit area.

5. The steel material of claim 1, wherein in a ¼t point, a tensile strength is 480 MPa or more, and Charpy impact absorption energy at a temperature of −50° C. is 150J or more, where t refers to a thickness, in mm, of the steel material.

6. The steel material of claim 1, wherein in a ½t point, tensile strength is 480 MPa or more, and Charpy impact absorption energy at a temperature of −50° C. is 100J or more, where t refers to a thickness, in mm, of the steel material.

7. The steel material of claim 1, wherein the steel material is subjected to a post weld heat treatment (PWHT).

8. The steel material of claim 1, wherein the steel material has a thickness of 10 to 150 mm.

9. A method of manufacturing the steel material for the pressure vessel of claim 1, the method comprising:

reheating a steel slab to a temperature of 1050 to 1200° C., the steel slab including, by weight percentage, wt %, 0.1 to 0.15% of carbon (C), 0.15 to 0.5% of silicon (Si), 1.2 to 1.8% of manganese (Mn), 0.01% or less, excluding 0%, of phosphorus (P), 0.01% or less, excluding 0%, of sulfur (S), 0.01 to 0.05% of aluminum (Al), 0.01 to 0.05% of niobium (Nb), 0.01 to 0.25% of nickel (Ni), 0.1% or less, excluding 0%, of copper (Cu), 0.01 to 0.1% of molybdenum (Mo), 0.01 to 0.05% of vanadium (V), 0.003% or less, excluding 0%, of titanium (Ti), 5 ppm or less, excluding 0 ppm, of boron (B), 20 to 100 ppm of nitrogen (N), a balance of iron (Fe) and inevitable impurities, and satisfying Relational Expression 1 below;

rough rolling the reheated steel slab within a temperature range of Ar3+100° C. to 1200° C.;

finish hot rolling the rough-rolled steel slab at a temperature of Ar3+30° C. or higher to manufacture a hot-rolled steel sheet;

air cooling the hot-rolled steel sheet to room temperature;

reheating the air-cooled hot-rolled steel sheet to a temperature of Ac3 or higher, and then maintaining the reheated hot-rolled steel sheet for (1.3t+20) minutes or more, where t refers to a thickness, in mm, of the steel material;

cooling the hot-rolled steel sheet to room temperature at a cooling rate of 2° C./sec or higher after the maintaining;

performing a tempering process in which the cooled hot-rolled steel sheet is maintained within a temperature range of 600 to 700° C. for (1.9*t*+30) minutes or more; and air cooling the hot-rolled steel sheet to room temperature after performing the tempering process, $$0.5<[(Ti+Nb+B)/3.5N+(Cu/Ni)]<2.5 \quad \text{[Relational Expression 1]}$$

where each element refers to a content by wt %.

10. The method of claim 9, wherein the steel slab is a continuous casting steel slab obtained through continuous casting at a temperature of Ar3 or higher, or a forging steel slab obtained by forging the continuous casting steel slab to a thickness decreased by 10 to 60% of an initial thickness.

11. The method of claim 9, further comprising:

performing a post weld heat treatment (PWHT) on the hot-rolled steel sheet, air-cooled to room temperature after performing the tempering process, within a temperature range of 595 to 635° C. for 120 minutes or more.

* * * * *